US011987946B2

(12) United States Patent
Lipton et al.

(10) Patent No.: US 11,987,946 B2
(45) Date of Patent: May 21, 2024

(54) EXPANDABLE FLOOD BARRIER

(71) Applicant: Enhanced Sustainability Inc., Toronto (CA)

(72) Inventors: Ian Lipton, Toronto (CA); Mehrdad Taheran, Shawinigan (CA); Satinder Kaur Brar, Toronto (CA)

(73) Assignee: Enhanced Sustainability Inc., Toronto (CA)

( * ) Notice: Subject to any disclaimer, the term of this patent is extended or adjusted under 35 U.S.C. 154(b) by 0 days.

(21) Appl. No.: 17/344,702

(22) Filed: Jun. 10, 2021

(65) Prior Publication Data

US 2021/0388567 A1 Dec. 16, 2021

Related U.S. Application Data

(60) Provisional application No. 63/037,384, filed on Jun. 10, 2020.

(51) Int. Cl.
*E02B 3/10* (2006.01)

(52) U.S. Cl.
CPC ..... *E02B 3/108* (2013.01)

(58) Field of Classification Search
CPC ..... E02B 3/104; E02B 3/106; E02B 3/108; E02B 7/20; E04H 9/145
See application file for complete search history.

(56) References Cited

U.S. PATENT DOCUMENTS 3,213,628 A * 10/1965 Serota ..... E04H 15/20 D25/19
4,555,201 A * 11/1985 Paoluccio ..... E02B 3/127 405/21
5,984,577 A * 11/1999 Strong ..... E02B 3/108 405/91
6,126,362 A * 10/2000 Carter ..... E02B 3/108 405/91
6,216,399 B1 * 4/2001 Belarbi ..... E02B 3/104 405/114
6,296,420 B1 * 10/2001 Garbiso ..... E02B 3/108 383/69
6,679,654 B1 * 1/2004 Wittenberg ..... E02B 3/108 256/13
6,715,960 B2 * 4/2004 Metz ..... E02B 3/108 405/116
7,600,944 B1 * 10/2009 Keating ..... E04H 9/145 52/302.1

(Continued)

OTHER PUBLICATIONS

Ljungberg, L. Y.; "Materials selection and design for structural polymers"; Materials & Design. 24(5); 2003; pp. 383-390.

(Continued)

*Primary Examiner* — Benjamin F Fiorello
(74) *Attorney, Agent, or Firm* — Laurie Wright; Christopher N. Hunter; Blake, Cassels & Graydon LLP

(57) ABSTRACT

A flood barrier component comprising a base; a plurality of wall extending upwardly from the base; a top coupled to an upper edge of said plurality of walls and defining a cavity between said base, plurality of walls and said top; the top or the at least one of said plurality of sides to be placed in contact with the flood waters being capable of allowing the flood waters to pass through the top or the at least one of said plurality of sides into the interior of the flood barrier component and being retained therein.

17 Claims, 6 Drawing Sheets

(56) References Cited

U.S. PATENT DOCUMENTS

| | | | | |
|---|---|---|---|---|
| 8,500,365 | B1 * | 8/2013 | Vecherin | E04H 9/145 405/110 |
| 9,181,669 | B2 * | 11/2015 | Stroup | B64F 5/30 |
| 9,708,785 | B1 * | 7/2017 | Bollman | E02B 3/108 |
| 10,465,409 | B1 * | 11/2019 | Barber | F04D 13/16 |
| 2005/0169712 | A1 * | 8/2005 | Young | E02B 3/108 405/116 |
| 2007/0108112 | A1 * | 5/2007 | Jones | E03B 3/00 210/170.11 |
| 2007/0125568 | A1 * | 6/2007 | Kida | E02B 3/108 174/77 R |
| 2012/0207545 | A1 * | 8/2012 | Bouchard | E02B 3/108 405/116 |
| 2013/0302092 | A1 * | 11/2013 | Ortiz | E02B 11/005 405/36 |
| 2017/0101758 | A1 * | 4/2017 | Abeles | E02B 7/005 |
| 2017/0350082 | A1 * | 12/2017 | Hamada | E02B 3/106 |
| 2019/0177940 | A1 * | 6/2019 | Van den Noort | E02B 3/062 |
| 2020/0123800 | A1 * | 4/2020 | Blyme | E04H 9/145 |

OTHER PUBLICATIONS

Lee, S.T.; Introduction: Polymeric Foams, Mechanisms, and Materials (Chapter 1), Melt Elasticity of Polyolefins: Impact of Elasticl Properties on Foam Processing (Chapter 2) in Polymeric Foams; CRC press; 2004.

Taheran, M. et al.; "Development of an advanced multifunctional portable water purifier"; Nanotechnology for Environmental Engineering 4(7); 2019; https://doi.org/10.1007/s41204-019-0054-6.

* cited by examiner

EXPANDABLE FLOOD BARRIER

FIELD OF THE INVENTION

The present invention is directed to an apparatus for containing a fluid within a defined space. More particularly, it pertains to an expandable flood barrier.

BACKGROUND OF THE INVENTION

There are several instances where it is necessary to contain a fluid within a defined space. For example, in an instance of a spill of contaminating fluid such as for example a crude oil or other petroleum products, it is necessary to maintain the fluid within a defined space. A further example of an instance where it is necessary to maintain a fluid within a defined space is as a result of flooding. Floods are among the most destructive climate-related disasters. In the past decade, the reported losses from floods have reached tens of billions of dollars and thousands of people were killed or evacuated each year. The increasing destructiveness of floods is correlated to growing populations and a greater number of people living in floodplains. In addition to damage in urban areas, floods are destructive in agricultural locations where their impact can linger for many years. For example, damage to soil and livestock can impact future productivity and therefore have long lasting economic impacts. The global flood statistics show 4,738 floods between 1900 and 2016 of which almost 60% of those have occurred in the last 18 years. Between 1900 and 1999, the average number of floods globally per year was 19.5. Since then, the average number has increased by almost 900% to 175 per year (Bremond et al, 2013, Economic evaluation of flood damage to agriculture-review and analysis of existing methods. Natural Hazards and Earth System Sciences. 13(10): p. 2493-2512 and Hirabayashi et al, 2013, Global flood risk under climate change. Nature Climate Change. 3: p. 816).

In flood conditions, it is necessary to maintain the floodwaters within a waterway and not allow the floodwaters to spill over and impact properties along the waterway. Currently, in a situation where a waterway such as a river is expected to flood and overrun the land adjacent to the waterway, there are different available flood barriers, such as sandbags, tube walls, box walls, etc., all of which are expensive to manufacture or use, heavy or spacious and have limitations in height. The most commonly utilized flood barrier is filling and stacking sandbags to provide a temporary levy for the floodwaters. While the use of sandbags has been the most effective and widely used to date, especially when used with pumps to pump any water back into the waterway which may penetrate the stacked sandbags, this is a very expensive and labour-intensive method as the materials for the sandbags have to be transported to the potential flood site, and then manually filled and transported to construct the levy.

Another problem encountered in flood conditions is the availability of potable water. Flood waters damage not only the properties but also the utility distribution systems, such as the potable water distribution network and the affected residents do not have access to potable water for several days after a flood occurs. This requires that potable water be transported to the flood site, at significant cost.

There thus remains a need for a flood barrier that can be transported and installed at the potential flood site more efficiently, with less required labour and at less potential expense than the prior art systems. Preferably, the flood barrier has the capability of storing floodwater, more preferably store floodwater in a manner to be used as potable water during that period.

SUMMARY OF THE INVENTION

The present invention is directed to a flood barrier component that can be easily and economically transported and installed at a potential flood site. Preferably, the flood barrier component has the capability of storing flood water, more preferably store flood water in a manner to be used as potable water during that period.

In one aspect, the flood barrier component is a generally rectangular box structure whereby a plurality of the flood barrier components are capable of being arranged to form a flood barrier. Each of the generally rectangular flood barrier components has a top, a bottom and sides to define the generally rectangular box, at least one side is to be placed into contact with the flood waters, the top or the at least one side to be placed in contact with the flood waters being capable of allowing the flood waters to pass through the top or the at least one side into the interior of the flood barrier component and being retained therein.

In another aspect of the invention, the top or the at least one side filters particulate matter to prevent such particulate matter from entering the interior of the flood barrier component.

In yet another aspect of the invention, the flood barrier component contains a filtration means within the interior to filter microorganisms and particulate matter to prevent such microorganisms and particulate matter from entering the interior of the filtration means.

In a further aspect of the invention, the sides of the flood barrier component are foldable to allow the empty flood barrier component to collapse to a reduced height for transport and to expand as the flood waters pass into the interior of the flood barrier component.

In another aspect of the invention, the flood barrier component is provided with a flotation means adjacent the top to maintain the top of the flood barrier component above the level of the flood waters.

BRIEF DESCRIPTION OF THE DRAWINGS

Preferred embodiments of the present invention are illustrated in the attached drawings in which.

DETAILED DESCRIPTION OF THE PREFERRED EMBODIMENTS

The present invention is directed to a flood barrier component that can be easily and economically transported and installed at a potential flood site. Preferably, the flood barrier component has the capability of storing floodwater, more preferably filter floodwater in a manner to provide potable water during that period.

Figure 1:
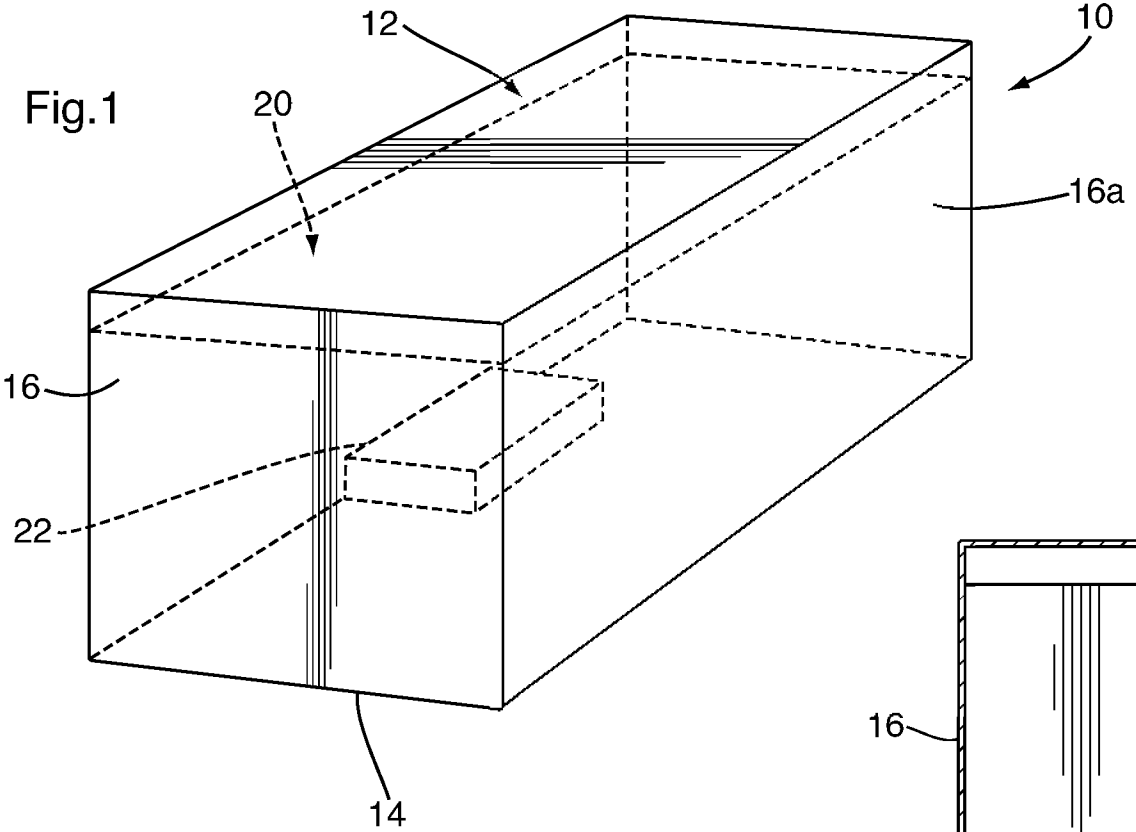
FIG. 1 is a perspective view of a first preferred embodiment of a flood barrier component of the present invention.
Figure 2:
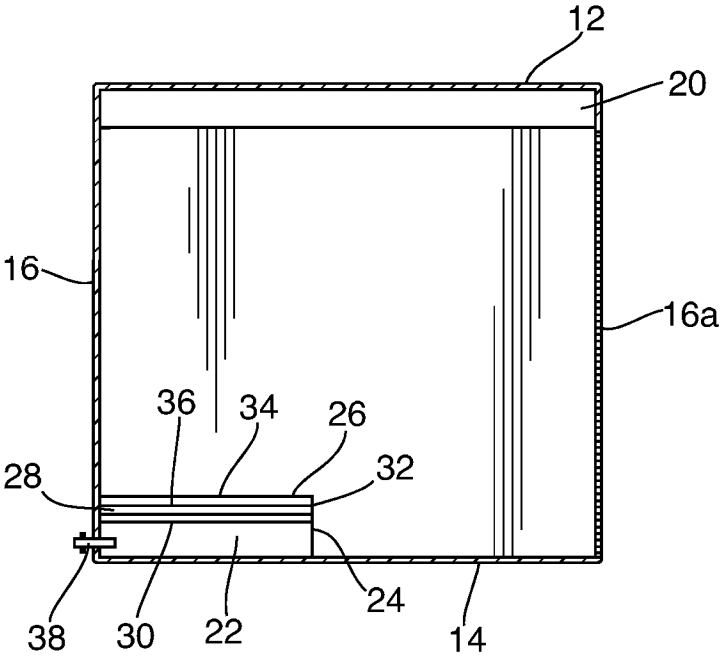
FIG. 2 is a cross-section view of the embodiment of the flood barrier component of FIG. 1.
Figure 3:
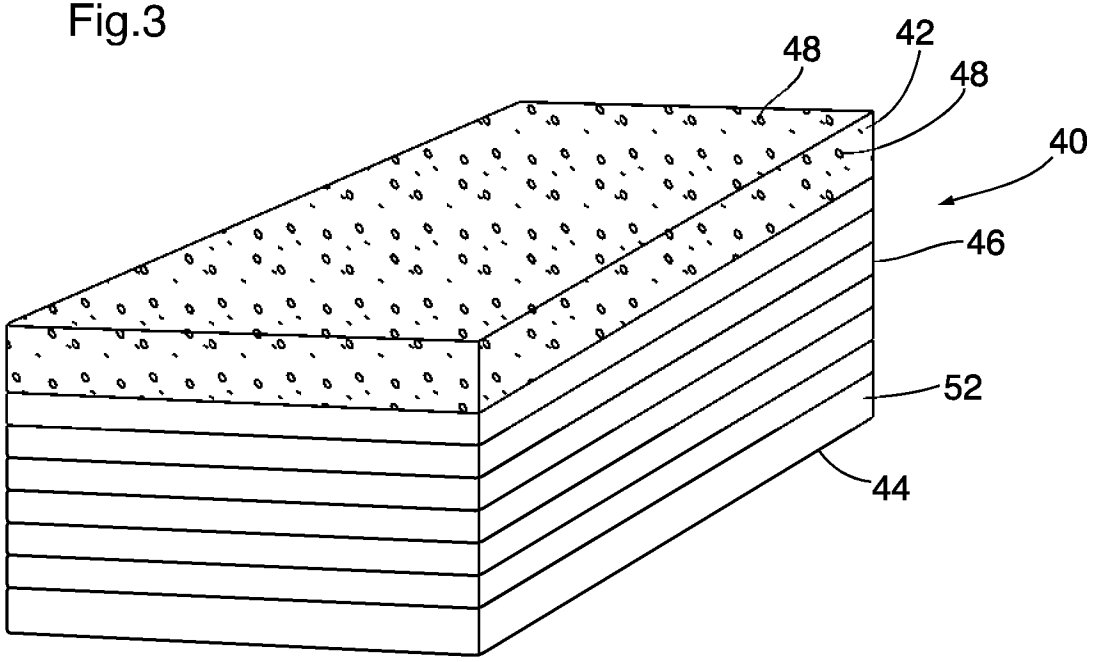
FIG. 3 is a perspective view of a second embodiment of a flood barrier component of the present invention.
Figure 4:
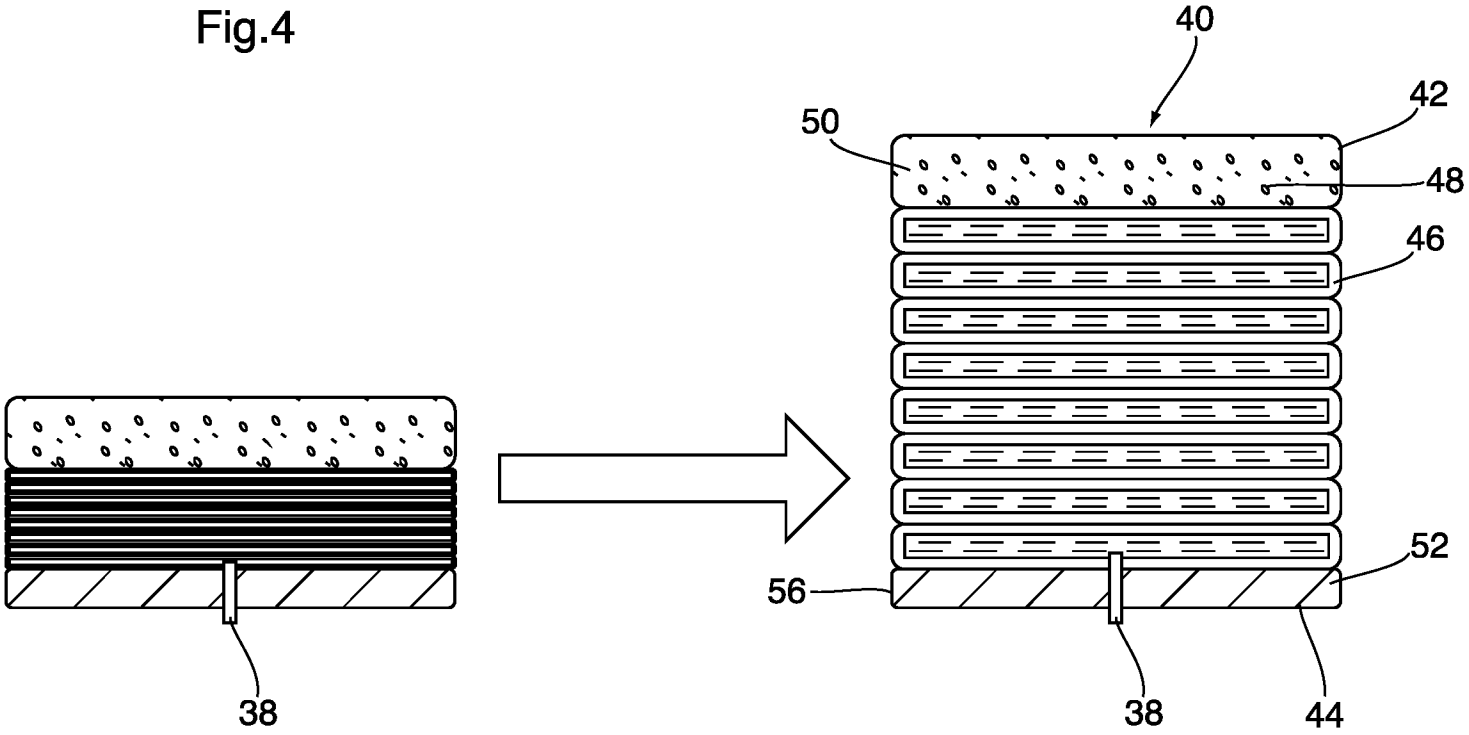
FIG. 4 is a cross-section view of the flood barrier component of FIG. 3.

A first preferred embodiment of the flood barrier component of the present invention is illustrated in FIGS. 1 and 2 designated by the numeral 10. The flood barrier component has a top 12, a bottom 14, and a plurality of sides 16. At least one of the sides 16*a* will be in contact with floodwaters when the flood barrier component 10 is being utilized. The side 16*a* is constructed of a material to allow the floodwaters to pass through into the interior of the flood barrier component. The material could be a fine open mesh to filter out some of the larger particulate materials which will be present in the floodwaters. The other sides 16, the top 12, and the bottom 14 are preferably constructed of a generally water impermeable material such that when the floodwaters are retained within the flood barrier component 10, they cannot pass through the top 12, bottom 14 or the other sides 16. The water impermeable material can be polypropylene, high density polyethylene, plasticized polyvinyl chloride, etc.

In order to aid in the inflation of the water barrier component, it is preferred to provide a flotation device 20 adjacent the top 12. Preferably, the flotation device 20 is a polymeric foam that is attached to the top 12 and sides 16 by a suitable means such as hot press manufacturing process. In this method, the flotation device 20 and the top 12 or sides 16 are heated to their softening temperature and then fused into each other by applying pressure up to approximately 1 MPa. Depending upon the nature of the polymer materials of the flotation device 20, top 12 and sides 16, the softening temperature will generally be between 90 and 180 C.

The polymeric foam for the flotation device 20 is selected to optimize the balance between buoyancy and gravitational forces to enable efficient operation of the flood barrier component 10 as the floodwaters are entering the flood barrier component 10. Preferably, the density of the foam will be between 0.1 and 0.9 g/cm$^3$. The foam is preferably a closed cell foam to maintain its buoyancy when in contact with the water within the flood barrier component 10. More preferably, the foam is a polystyrene foam panel having a density of between 0.1 and 0.9 g/cm$^3$.

Preferably, the flood barrier component contains a filter component 22 to filter fine particulate matter and microorganisms from the water entering the filter component 22 to provide potable water within the filter component 22. In one embodiment, illustrated in FIGS. 1 and 2, the filter component 22 is a circular or rectangular structure having walls 24 fused to the bottom 14 of the interior of the flood barrier component 10. In a preferred embodiment, one of the filter component wall 24 being fused to the wall 16 of the flood barrier component opposite the wall 16*a* is in contact with the floodwaters.

As shown in FIG. 2, the top 26 of the filter component 22 contains the filter material 28 sandwiched between a lower support plate 30 and an upper support plate 32 sized to support the filter material 28 and protect it from the pressure of the water contained within the flood barrier component 10. The lower support plate 30 is preferably a perforated plate having holes to allow the filtered water to enter the filter component 22. The size and spacing of the holes provide for the passage of the water while also providing support for the filter material 28 to prevent tearing or puncturing of the filter material 28.

The upper support plate 32 may also be a perforated plate or it may be a mesh screen, as illustrated in FIG. 2. The purpose of the upper support plate 32 is to support the upper surface of the filter material 28 to prevent tearing or puncturing of the filter material. If the upper support plate 32 is a mesh material, the screen size can be selected to block particulate material from contacting the filter material 28 and potentially damaging or blocking the pores of the filter material 28.

In order to enhance the performance of the filter component 22, a prefilter 34 may be provided to filter particulate material from the water before it comes into contact with the filter material 28. The prefilter 34 may be located between the upper support plate 32 and the filter material 28 or it may be located above the upper support plate 32, in which case, a prefilter support mesh 36 is provided above the prefilter 34, as shown in FIG. 2.

The filter component 22 is provided with an outlet 38 to allow the potable filtered water to be withdrawn for use. The outlet 38 is provided with a valve to allow for the withdrawal of the water. The filter component 22 will be sized to provide sufficient potable water to meet the daily requirements of at least one person taking into account the filtration rate of the filter material.

The filter material 28 will have a pore size of less than 1 μm, preferably between 0.1 μM and 0.5 μM, more preferably between 0.2 and 0.5 μM. The filter material 28 may be any of the commonly used filtration materials such as polyacryloritrile, cellulose acetate, polysulfone, etc. The filter material 28 preferably will have an efficiency of 99.99% or greater and a mechanical strength of 1 MPa or greater. The filter material 28 will have a filtration capacity of 10 cm$^3$/min·cm$^2$ or greater, preferably of the filter material 28 is of 20 cm$^3$/min. cm$^2$ or greater. The selection of the filter material 28 is within the common general knowledge of those of skill in the art.

The prefilter 34 will have a pore size of greater than 1 μM and may be any of the commonly used materials similar to the filter material 28. The prefilter 34 will have a higher filtration capacity than the filter material 28, generally greater than 20 cm$^3$/min. cm$^2$, preferably greater than 50 cm$^3$/min. cm$^2$.

A further preferred embodiment of the water barrier component is illustrated in FIGS. 3 to 7, generally indicated by numeral 40. The flood barrier component has a top 42, a bottom 44 and a plurality of sides 46. At least one of the sides 46 will be in contact with floodwaters when the flood barrier component 40 is being utilized. The sides 46 and the bottom 44 are preferably constructed of a water impermeable material such that when the floodwaters are retained within the flood barrier component 40, they cannot pass through the bottom 44 or the sides 46. The water impermeable material can be polypropylene, high density polyethylene, plasticized polyvinyl chloride, etc.

The top 42 is constructed of a material to allow the floodwaters to pass through into the interior of the flood barrier component. Preferably, in order to aid in the inflation of the water barrier component, the top 42 is a flotation device. Preferably, the flotation device 42 is a polymeric foam that is attached to the sides 46 by a suitable means such as hot press manufacturing process. In this method, the flotation device 42 and the sides 46 are heated to their softening temperature and then fused into each other by applying pressure up to 1 MPa. Depending upon the nature of the polymer materials of the flotation device 42 and top 48, the softening temperature will generally be between 90 and 180 C.

The polymeric foam 48 for the flotation device 42 is selected to optimize buoyancy while allowing the floodwater to pass through into the interior of the flood barrier component 40. Preferably, the density of the polymeric foam will be between 0.1 and 0.9 g/cm$^3$, more preferably at the lower end of the range, between 0.1 and 0.5 g/cm$^3$. The polymeric foam 48 could be an open cell foam to allow the water to pass through the open cell channels while maintaining its buoyancy when in contact with the water in the flood barrier component 40. Preferably, the polymeric foam 48 is a closed cell foam provided with water channels to allow the water to pass through the foam 42 from both the top and side surface. More preferably, the polymeric foam is a polystyrene foam panel.

Preferably, to allow for easy collapse and expansion of the flood barrier component 40, the sides 46 are an accordion structure to provide for easy storage in the collapsed position and easy expansion as the water enters into the interior of the flood barrier component 40.

The flood barrier component 40 is provided with a filter component 50 which can be the same structure 22 as the first embodiment described above, Alternatively, as illustrated in FIGS. 3 to 7, the filter component 50 can be provided in the lower most chamber 52 of the accordion structure. The lower most chamber 52 would have reinforced sides to maintain their generally vertical shape when the flood barrier component 40 is filled with water. Similar to the first embodiment, a perforated lower support plate, filter material, upper support plate and prefilter would be provided using similar arrangements as the first embodiment.

Similar to the first embodiment, an outlet and valve would also be provided to allow the potable water to be withdrawn from the filter component 50.

Figure 5:
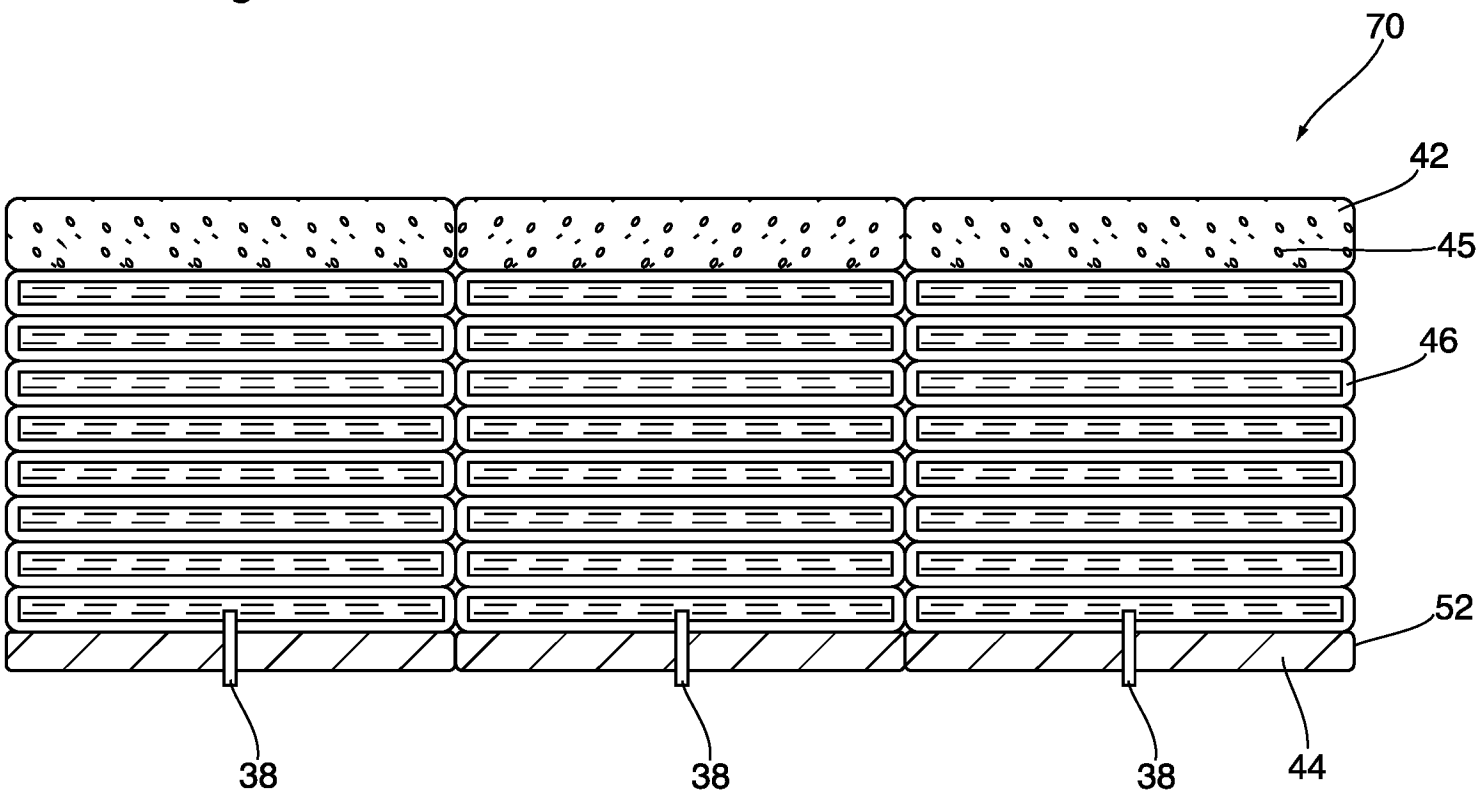
FIG. 5 is a side view of the flood barrier component of FIG. 3 joined together to form a flood barrier.
Figure 6:
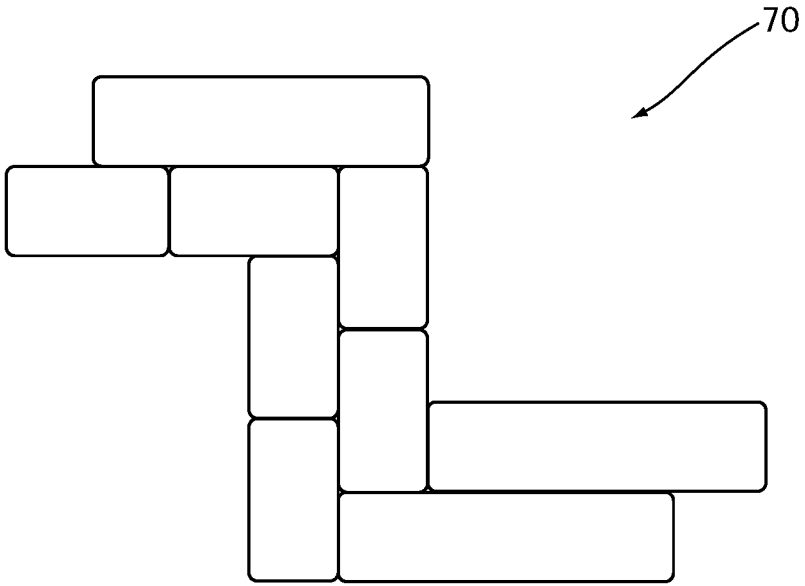
FIG. 6 is a top plan view of a possible arrangement of a flood barrier of the present invention.

As illustrated in FIGS. 5 and 6, the flood barrier component 10 or 40 are joined together, side by side, to form a flood barrier 70. Owing to the modular design of the flood barrier component 40, they can be arranged in whatever order necessary to protect the residential, commercial, industrial and institutional buildings, as well as public infrastructure from flood waters due to increasingly sever and frequent storms. By providing the filter components, they can also filter flood water into clean potable water.

Figure 7:
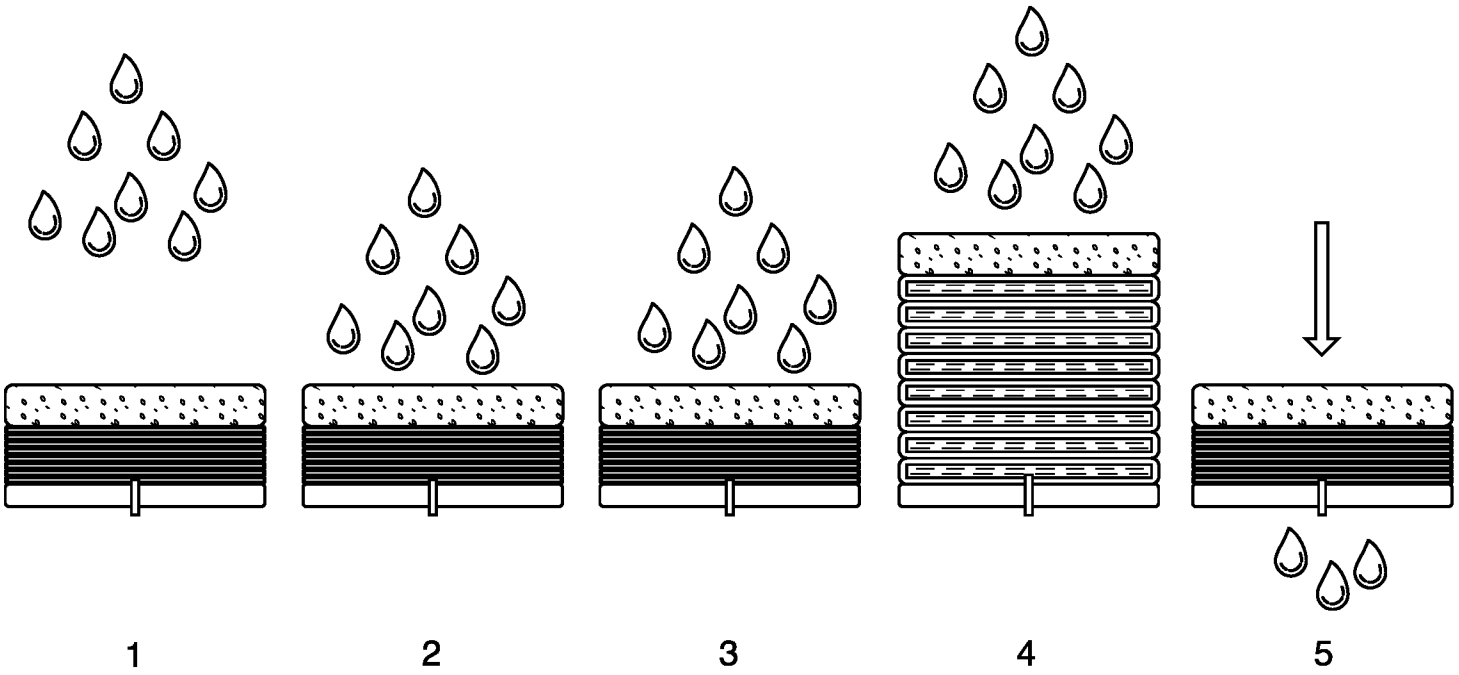
FIG. 7 is a side view of the flood barrier component of FIG. 3 in operation.

As shown in FIG. 7, with the second embodiment, as flood water reaches the flotation foam 42, it passes through the channels 45 (shown on FIG. 5) and into the interior of flood barrier component 40. Rainwater enters the water channel provided in the top of the flotation foam. Due to the buoyancy of the flotation foam 42, it always stays above the flood waters providing a barrier to the floodwaters.

Once the floodwaters recede, the flood barrier components can be emptied, cleared, and stored until needed again.

By providing the flood barrier components 10 or 40 with the filter components 22 or 50, the flood barrier components can also provide a source of clean potable water. In addition to acting as a flood barrier, the second embodiment of the flood barrier component can also provide a source of clean potable water in emergency of arid conditions. Rainwater or other contaminated water can be poured into the top of the flood barrier component and clean potable water can be obtained.

The flood barrier components, of the present invention, provide a quick and simple method of erecting flood barriers to protect buildings and infrastructure from potential damage from floods. They are easily and quickly erected without requiring the significant amounts of materials and manpower of traditional methods. Once the flood is over, they are easily dismantled and stored for the next use.

While various preferred embodiments of the flood barrier component of the present invention have been described herein in detail, it will be apparent that variations may be made as would be known by those of ordinary skill in the art.

The invention claimed is:

1. A flood barrier component in the shape of a polyhedron comprising:

a bottom wall;

a plurality of side walls having a bottom edge and top edge, said bottom edge of said plurality of side walls coupled to an outer edge of said bottom wall;

a top having an outer edge thereof, said top edge of said plurality of side walls coupled to the outer edge of said top;

the plurality of side walls configured to be moveable between a collapsed position and an extended position;

in said extended position, said plurality of side walls, said bottom wall and said top defining a space therebetween;

at least a portion of said plurality of side walls or top is permeable to water, allowing water to enter the interior into the space;

wherein said top is formed of a material with a density less than that of water such that said top acts as a floatation device; and wherein upon entry of water into the space, the positive buoyancy of the floatation device in the water, raises the floatation device to move the plurality of side walls from said collapsed position to said extended position; and wherein said flood barrier component is configured to be portable.

2. A flood barrier as claimed in claim 1 wherein said permeable wall filters large particulate materials.

3. A flood barrier as claimed in claim 2 further comprising an internal filter component located within the space to filter fine particulate matter from water entering an interior of said internal filter component; said internal filter component further comprising an output valve to allow water within said internal filter component to be dispensed.

4. A flood barrier as claimed in claim 3 wherein said internal filter component further filters microorganisms from water within said flood barrier component.

5. A flood barrier as claimed in claim 4 wherein said internal filter component is contained within a filter structure coupled to at least one of said plurality of side walls or bottom wall to isolate water filtered through said filter component from flood water contained within said flood barrier.

6. A flood barrier as claimed in claim 5 wherein said filter structure is coupled to a filter wall which is positioned opposite said permeable wall.

7. A flood barrier as claimed in claim 6 wherein said filter structure is adjacent to or coupled to said bottom wall.

8. A flood barrier as claimed in claim 7 wherein said output valve is a spout is positioned through one of the plurality of side walls of said flood barrier; said spout being movable between an open position allowing water within the filter structure to flow out of said flood barrier and a closed position to stop the flow of water; said spout position to be in communication with the interior of said filter structure.

9. A flood barrier as claimed in claim 8 wherein said filter structure further comprises an upper support plate and a lower support plate positioned with said filter component therebetween.

10. A flood barrier as claimed in claim 9 wherein said filter structure has a top and at least one side wall extending upwardly from the bottom wall of said flood barrier, said at least one side wall of said filter structure being impermeable to water and said top being permeable and comprised of said upper support plate, said lower support plate and said filter component positioned therebetween.

11. A flood barrier as claimed in claim 10 wherein said filter structure is cylindrical in shape.

12. A flood barrier as claimed in claim 10 wherein said filter structure is rectangular in shape.

13. A flood barrier as claimed in claim 1 wherein the floatation device is made from polymeric foam.

14. A flood barrier as claimed in claim 1 wherein the floatation device is non-inflatable.

15. A flood barrier as claimed in claim 1 wherein the side walls are an accordion structure.

16. A flood barrier as claimed in claim 1 wherein the top is the at least one wall that is permeable to allow water into the space.

17. A flood barrier as claimed in claim 16 wherein the plurality of side walls and bottom wall are non-permeable to water.

* * * * *